US006402929B1

(12) United States Patent
Sakata et al.

(10) Patent No.: US 6,402,929 B1
(45) Date of Patent: Jun. 11, 2002

(54) METHOD OF OPERATING ALKALI CHLORIDE ELECTROLYTIC CELL

(75) Inventors: Akihiro Sakata, Tokyo; Koji Saiki; Takeshi Watanabe, both of Osaka, all of (JP)

(73) Assignees: Toagosei Co., Ltd., Tokyo; Kaneka Corporation, Osaka; Mitsui Chemicals, Inc., Tokyo, all of (JP)

( * ) Notice: Subject to any disclaimer, the term of this patent is extended or adjusted under 35 U.S.C. 154(b) by 8 days.

(21) Appl. No.: 09/612,194

(22) Filed: Jul. 7, 2000

(30) Foreign Application Priority Data

Jul. 7, 1999 (JP) ..... 11-193241

(51) Int. Cl.[7] ..... G25B 1/16; G25B 1/34
(52) U.S. Cl. ..... 205/510; 205/516
(58) Field of Search ..... 205/516, 510–515

(56) References Cited

U.S. PATENT DOCUMENTS 3,928,150 A * 12/1975 Rahn et al. ..... 204/256 X
4,035,254 A 7/1977 Gritzner
4,222,831 A * 9/1980 Specht et al. ..... 205/516
4,459,196 A * 7/1984 Iijima et al. ..... 204/258
4,595,469 A * 6/1986 Foller ..... 205/510
4,921,587 A * 5/1990 Dong et al. ..... 204/254 X
4,950,370 A * 8/1990 Tarancon ..... 205/619

FOREIGN PATENT DOCUMENTS

JP 7090662 4/1995
JP 10110286 4/1998

* cited by examiner

*Primary Examiner*—Donald R. Valentine
(74) *Attorney, Agent, or Firm*—Young & Thompson

(57) ABSTRACT

A method of operating an alkali chloride electrolytic cell, comprising: providing an alkali chloride electrolytic cell comprising a gas diffusion cathode and a cation-exchange membrane, the gas diffusion cathode and cation-exchange membrane defining a caustic chamber; allowing a caustic alkali aqueous solution to flow in the caustic chamber at a linear velocity of at least 1 cm/sec.

2 Claims, 1 Drawing Sheet

METHOD OF OPERATING ALKALI CHLORIDE ELECTROLYTIC CELL

FIELD OF THE INVENTION

This invention relates to a method of operating an alkali chloride electrolytic cell. More particularly, it relates to a method of operating an alkali chloride electrolytic cell which maintains a high current efficiency while preventing deterioration of the ion exchange membrane.

RELATED ART

A method of obtaining a caustic alkali by electrolysis of an alkali chloride aqueous solution by an ion-exchange membrane method which uses a gas diffusion cathode is known. This method is achieved with an electrolysis cell partitioned with an ion-exchange membrane, usually a cation-exchange membrane, into an anode chamber having an anode and containing an alkali chloride aqueous solution and a cathode chamber having a cathode and containing water or a caustic alkali aqueous solution, in which a gas diffusion cathode made of a porous body and supplied with an oxygen-containing gas is used as the cathode to produce a caustic alkali in the cathode chamber. The merit of this technique consists in that hydrogen gas does not generate on the cathode so that the requisite electrolytic voltage is markedly reduced.

Documents disclosing the above-mentioned electrolysis method includes JP-A-54-97600 (The term "JP-A" used he rein means an "unexamined published Japanese patent application"), JP-A-56-44784, JP-A-56-130482, JP-A-57-152479, JP-A-59-133386, JP-A-61-266591, JP-B-58-44156 (The term "JP-B-" used herein means an "examined Japanese patent publication"), JP-B-58-49639, JP-B-60-9595, and JP-B-6120634.

As is recognized from the teachings disclosed, the subjects of conventional studies on electrolysis by the ion-exchange membrane method have been confined to the techniques for producing, or improving of the performance of, a gas diffusion cathode, with little consideration given to the improvement on the method of operating the electrolytic cell used in the ion-exchange membrane method. In order to efficiently operate the electrolytic cell of this type, it is important to establish such operating conditions as to keep the ion-exchange membrane in its best condition.

In carrying out alkali chloride electrolysis by a conventional ion-exchange membrane method without using a gas diffusion cathode, the cell is partitioned with an ion-exchange membrane into an anode chamber having an anode and a cathode chamber having a cathode, and an alkali chloride aqueous solution is fed to the anode chamber, where chlorine gas is produced; and water or a dilute aqueous solution of a caustic alkali is fed to the cathode chamber, where a caustic alkali and hydrogen gas are produced. The anode and the cathode are made of gas- and liquid-permeable materials. An anolyte (aqueous alkali chloride solution) and a catholyte (aqueous caustic alkali solution) are supplied from the back side of the respective electrodes, and the gas generated on the electrodes is discharged to the back side of the respective electrodes. The cell being so constructed, the anode chamber and the cathode chamber contain gas and liquid in a mixed state so that the gas produces a liquid agitating effect. As a result, the alkali chloride concentration in the anode chamber and the caustic alkali concentration in the cathode chamber are both maintained substantially uniform.

The situation in the alkali chloride electrolytic cell having a gas diffusion cathode is different. That is, an anode chamber having an anode, an ion-exchange membrane, a caustic chamber, a gas diffusion cathode, and a gas chamber are arranged in this order, and an alkali chloride aqueous solution is fed to the anode chamber, where chlorine gas evolves. In this respect, the cell structure is basically the same with that used in the method using no gas diffusion electrode. The difference lies in that an oxygen-containing gas is fed to the gas chamber which is adjacent to the gas diffusion cathode on the side opposite to the ion-exchange membrane and that a caustic alkali is produced in the caustic chamber provided between the ion-exchange membrane and the gas diffusion cathode. The caustic chamber is supplied with water or a dilute aqueous solution of a caustic alkali.

Because no gas evolves on the gas diffusion cathode, there is no gas in the aqueous caustic alkali in the caustic chamber. Accordingly, the aqueous caustic alkali is not to be agitated by generated gas as is observed with the case of electrolysis using no gas diffusion cathode. It follows that the caustic alkali concentration in the caustic chamber tends to be non-uniform. In order to avoid this, circulation of a caustic alkali aqueous solution has been adopted.

Circulation of a caustic alkali aqueous solution has also been used in conventional electrolysis systems having no gas diffusion cathode. In these systems, the discharged caustic alkali concentration ranges from 30 to 35% by weight, while the concentration of the supplied dilute caustic alkali is lower than that by a few percents.

Where the circulation system is applied to the alkali chloride electrolytic cell having a gas diffusion cathode, the caustic alkali concentration distribution in the caustic chamber can be controlled within several percents, which has been accepted non-problematical in running. However, when such operation is continued for a long period of time, a reduction in current efficiency can result because of deterioration of the ion-exchange membrane. The cause of the deterioration of the ion-exchange membrane is assumed ascribable to the substantial increase in caustic alkali concentration in the vicinities of the ion-exchange membrane.

SUMMARY OF THE INVENTION

It is therefore an object of the present invention to provide a method of operating an alkali chloride electrolytic cell having a gas diffusion cathode to electrolyze an alkali chloride aqueous solution to produce chlorine and a caustic alkali, in which the ion-exchange membrane is prevented from deterioration thereby to maintain high current efficiency for an extended period of time.

Other objects and effects of the present invention will become apparent from the following description.

The present inventors have extensively investigated a countermeasure against deterioration of the ion-exchange membrane in the production of chlorine and a caustic alkali by electrolyzing an alkali chloride aqueous solution in an electrolytic cell having a gas diffusion cathode. As a result, they have found that the object is accomplished by feeding a caustic alkali aqueous solution to the caustic chamber between the cation-exchange membrane and the gas diffusion cathode at or above a given flow rate. They have found that the caustic alkali concentration in the vicinities of the ion-exchange membrane is maintained on a proper level by controlling the flow of the aqueous caustic alkali solution in the caustic chamber thereby to prevent the ion-exchange membrane from being deteriorated and, as a result, high current efficiency can be retained for a prolonged period of time.

The present invention provides the following methods of operating an alkali chloride electrolytic cell.

(1) A method of operating an alkali chloride electrolytic cell, comprising:

providing an alkali chloride electrolytic cell comprising a gas diffusion cathode and a cation-exchange membrane, said gas diffusion cathode and cation-exchange membrane defining a caustic chamber;

allowing a caustic alkali aqueous solution to flow in said caustic chamber at a linear velocity of at least 1 cm/sec.

(2) The method according to the above method (1), wherein the linear velocity of said caustic alkali aqueous solution is from 1 cm/sec to 10 cm/sec.

DETAILED DESCRIPTION OF THE INVENTION

Alkali chloride electrolysis by the ion-exchange membrane method using a gas diffusion cathode involves a cathode reaction in which oxygen and water participate as represented by formula:

$$1/4O_2+1/2H_2O+e\rightarrow OH^-$$

Figure 1:
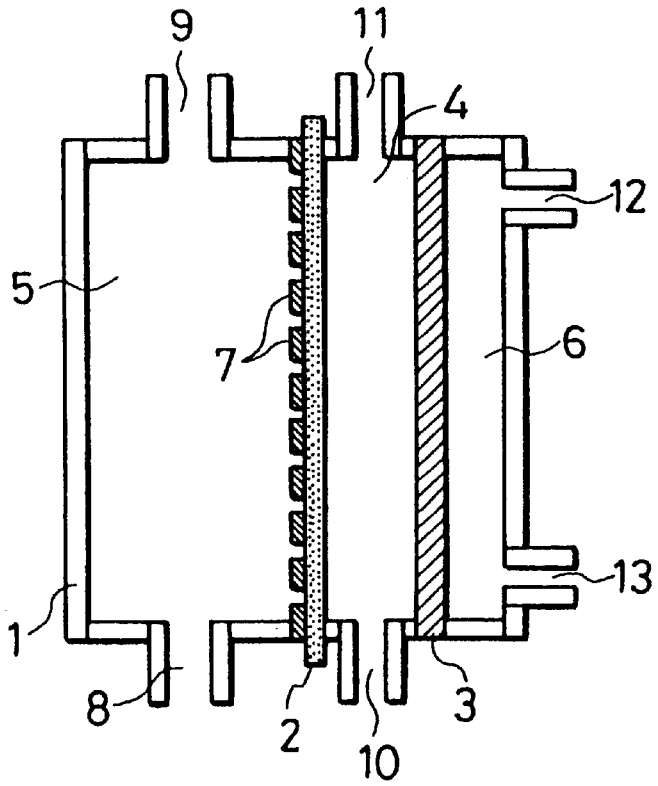
FIG. 1 is a schematic illustration of an electrolytic cell by an ion-exchange membrane method using a gas diffusion cathode.

An example of the electrolytic cell by the ion-exchange membrane method using a gas diffusion cathode is schematically illustrated in FIG. 1. The box type electrolytic cell 1 shown in FIG. 1 has an ion-exchange membrane 2 and a gas diffusion electrode 3 that are vertically set up in parallel to each other to partition the cell into a caustic chamber 4, an anode chamber 5 and a gas chamber 6. The caustic chamber 4 is between the ion-exchange membrane 2 and the gas diffusion electrode 3, the anode chamber 5 is adjacent to the caustic chamber 4 with the ion-exchange membrane 2 therebetween, and the gas chamber 6 is adjacent to the caustic chamber 4 with the gas diffusion electrode 3 therebetween.

The anode chamber 5 has a gas-permeable anode 7 in intimate contact with the ion-exchange membrane 2, an anolyte feed opening 8 at the bottom, and an anolyte discharge opening 11 at the top. The caustic chamber 4 has a caustic solution feed opening 10 at the bottom and a caustic solution discharge opening 11 at the top. The gas chamber 6 has a gas feed opening 12 at the top and a gas discharge opening 13 at the bottom.

The mechanism of the anode chamber 5 is, in principle, the same as in the electrolytic cell by an ordinary ion-exchange membrane method using no gas diffusion cathode 3. An alkali chloride aqueous solution is supplied from the anolyte feed opening 8 and electrolyzed on the gas-permeable anode 7 to form chlorine gas and a dilute aqueous solution of the alkali chloride, which are discharged from the anolyte discharge opening 9. The alkali metal ions generated on the anode pass through the ion-exchange membrane 2 in the thickness direction into the caustic chamber 4.

To the caustic chamber 4 are fed a caustic alkali aqueous solution or water from the caustic solution feed opening 10, and the reaction according to the formula shown above takes place by the action of the gas diffusion cathode 3. The hydroxyl ions produced react with the alkali metal ions having penetrated through the ion-exchange membrane 2 to form a caustic alkali, which is discharged from the caustic solution discharge opening 11. At the same time, an oxygen-containing gas is supplied through the gas feed opening 12 to the gas chamber 6, which is provided next to the gas diffusion cathode 3 on the side opposite to the caustic chamber 4, and discharged from the discharge opening 13.

In the above-described electrolytic cell, the aqueous caustic alkali solution in the caustic chamber 4 is apt to get non-uniform because of the absence of gas which might have produced an agitating effect. To make the aqueous caustic alkali solution in the caustic chamber 4 uniform, it is a practice generally followed that the aqueous caustic alkali solution is circulated by means of an external circulation system.

Figure 2:
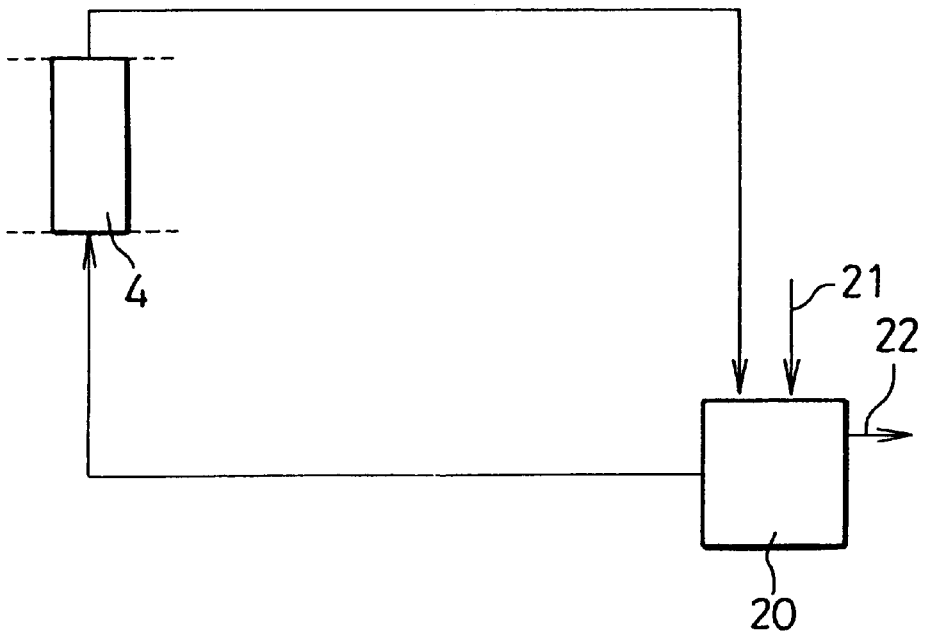
FIG. 2 schematically illustrates a circulation mode of a caustic alkali aqueous solution by means of an external circulation system.

FIG. 2 schematically illustrates the circulation mode of the aqueous caustic alkali solution by means of an external circulation system, wherein water 21 and a dilute caustic alkali 22 are fed to the caustic chamber 4 of the electrolytic cell 1 (not shown in FIG. 2) by means of an externally provided circulation tank 20, and the discharged liquid from the caustic chamber 4 is returned to the circulation tank 20. The circulation tank 20 is supplied with water 21 to adjust the caustic alkali concentration. The caustic alkali 22 produced in the caustic chamber 4 is discharged from the circulation tank 20.

Even where electrolysis is performed in such a circulation mode, continuation of the operation can often result in a reduction of current efficiency, which has turned out to be ascribable to the deterioration of the ion-exchange membrane. The mechanism of the ion-exchange membrane's deterioration, while not necessarily clear, may be accounted for as follows. An ion-exchange membrane generally used in alkali chloride electrolysis allows sodium ions to permeate during electrolysis. At the same time, the membrane also allows water molecules to pass through. The amount of water that permeates usually ranges from about 3.5 to 4.0 times the molar quantity of sodium. The concentration of the caustic alkali in the vicinities of the ion-exchange membrane in the caustic chamber side must be as high as about 36 to 39%. It is accepted that the ion-exchange membrane should be used in a caustic alkali concentration between 30 and 35% and that operation in higher concentrations can result in deterioration of the ion-exchange membrane. Therefore, even though the average concentration throughout the caustic chamber is within a proper range, it is assumed that the higher concentration in the vicinity of the ion-exchange membrane can lead to the deterioration of the membrane.

It is a conceivable approach to the above problem to make the flow of the caustic alkali turbulent. A turbulent flow can be produced by, for example, placing an obstacle such as a spacer inside the caustic chamber to disturb the caustic alkali aqueous solution flow, introducing an inert gas to agitate the flow, or circulating the caustic alkali aqueous solution at a high rate. However, the method using a spacer as an obstacle cannot be said to be a good measure because the spacer is very likely to act as an electrical resistor in electrolysis. An increased resistance would lead to an increased voltage. Gas introduction is also accompanied with an increase in resistance.

The method relying on the high-speed flow of the caustic alkali aqueous solution is advantageous in that it is easy to carry out and does not need structural modification of the caustic chamber, while disadvantageous in that the flow rate sufficient to create a turbulent flow results in a vast amount of flow, which requires an increased cost of power.

According to the present inventors' study, however, it has been ascertained that a considerably low flow rate that falls short of creation of a turbulent flow is enough to prevent the ion-exchange membrane from being deteriorated. That is, the object of the invention is sufficiently accomplished by making the caustic alkali aqueous solution to flow in the caustic chamber at a linear velocity of at least 1 cm/sec. While the Reynolds' number required to create a turbulent flow in engineering is usually 4,000 or more, such a small flow rate as one several tens'th of that Reynolds' number is sufficient in the present invention, which is, in terms of linear velocity, 1 cm/sec or more. The linear velocity of 1 cm/sec corresponds to a Reynolds' number of about 60.

The upper limit of the linear velocity is practically 10 cm/sec and preferably 5 cm/sec. Accordingly, the linear velocity is preferably from 1 cm/sec to 10 cm/sec, and more preferable from 1 cm/sec to 5 cm/sec. While the linear velocity could exceed 10 cm/sec, too high a linear velocity not only increases the inner pressure of the caustic chamber, which may lead to damages to the ion-exchange membrane or the gas diffusion electrode, but is impractical in view of the cost of power.

In the case of electrolysis by the general ion-exchange membrane method using no gas diffusion cathode, a caustic alkali aqueous solution is supplied from an external circulation tank to the cathode chamber (caustic chamber). This circulation aims at not only narrowing the caustic alkali concentration distribution in the cathode chamber but heating or cooling the caustic solution thereby to optimize the electrolytic cell temperature. Since hydrogen gas evolves in the cathode chamber to bring about agitation, the caustic alkali concentration is equalized. Therefore, an extremely small flow rate of the caustic alkali aqueous solution would be enough. The flow rate required for the temperature control is also small. Assuming that no hydrogen gas evolves in the above case, the linear velocity of the caustic alkali aqueous solution in the cathode chamber is as low as 0.1 cm/sec or less.

Where the general ion-exchange membrane method of electrolysis using no gas diffusion electrode is applied as such to the system using a gas diffusion electrode, long-term operation badly damages the ion-exchange membrane as stated above. According to the invention, the performance of the ion-exchange membrane can be maintained for a prolonged period of time by controlling the linear velocity of the caustic alkali aqueous solution flowing in the caustic chamber at or above 1 cm/sec, preferably within the range of from 1 to 10 cm/sec, still preferably within the range of from 1 to 5 cm/sec.

The linear velocity of the caustic alkali aqueous solution in the caustic chamber can be increased to 1 cm/sec or more by employing a circulation pump of sufficiently large capacity or by narrowing the caustic chamber. The latter method is preferred from the standpoint of reduction of the electrolytic voltage. Whichever method is adopted, what is important is to increase the linear velocity of the caustic alkali aqueous solution flowing in the caustic chamber.

According to the present invention, the ion-exchange membrane maintains high performance, being prevented from damage even in long-term operation, by the simple method comprising increasing the linear velocity of the caustic alkali aqueous solution in the caustic chamber.

The present invention will now be illustrated in greater detail with reference to the following Examples, but it should be understood that the invention is not limited thereto.

EXAMPLE 1

Electrolysis of sodium chloride was carried out under the conditions shown below. Condition of Electrolysis:

Electrode area: 1 $dm^2$ (10 cm×10 cm)

Current density: 30 $A/dm^2$

Anode: DSE (RTM, available from Permelec Electrode Ltd.; comprising a titanium base having a coating mainly comprising $RuO_2/TiO_2$)

Ion-exchange membrane: N954 (available from E.I. du Pont de Nemours & Co.)

Cathode: gas diffusion electrode (see below)

Distance between electrodes: anode/ion-exchange membrane=0 mm; ion-exchange membrane/cathode=5 mm Caustic soda concentration: 32%

Circulation rate of caustic soda: 30 liter/hr

Linear velocity of aqueous caustic soda in caustic chamber: 1.67 cm/sec

Anolyte concentration: NaCl=200 g/l Fed gas: oxygen gas of 1.6 times the theoretical The gas diffusion cathode used in the cell was prepared by hot pressing into one body a gas diffusion layer made of 60 wt % of hydrophobic carbon black (acetylene black produced by Denki Kagaku Kogyo K.K.) and 40 wt % of polytetrafluoroethylene (PTFE) (D-1, available from Daikin Industries, Ltd.), a reaction layer made of 20 parts by weight of hydrophilic carbon black (AB-12, available from Denki Kagaku Kogyo K.K.) and 10 parts by weight of PTFE, and a silver mesh as a current collector, and applying thereto 3 $mg/cm^2$ of silver as a catalyst.

The average electrolytic voltage during 370-day running was 2.31 V. The current efficiency was 98.18% after 70 days, 96.63% after 105 days, 95.15% after 215 days, and 95.23% after 362 days, being always maintained above 95%. No abnormalities was found in the ion-exchange membrane after the running.

COMPARATIVE EXAMPLE 1

Electrolysis was carried out under the same conditions as in Example 1, except that the circulation rate of the aqueous caustic soda was changed to 13 1/hr which corresponded to the linear velocity of 0.72 cm/sec. The average electrolytic voltage during 294-day running was 2.31 V. The current efficiency decreased with the time of running, being 94.93% after 54 days, 90.89% after 147 days, and 78.89% after 252 days. After the testing, the ion-exchange membrane was found to have blisters.

The present invention provides a method of operating an alkali chloride electrolytic cell having a gas diffusion cathode for producing chlorine and a caustic alkali, in which the ion-exchange membrane is prevented from being deteriorated thereby to secure high current efficiency for an extended period of time.

While the invention has been described in detail and with reference to specific embodiments thereof, it will be apparent to one skilled in the art that various changes and modifications can be made therein without departing from the spirit and scope thereof.

What is claimed is:

1. A method of operating an alkali chloride electrolytic cell, comprising:

providing an alkali chloride electrolytic cell comprising a gas diffusion cathode and a cation-exchange membrane, said gas diffusion cathode and cation-exchange membrane defining a caustic chamber;

allowing a caustic alkali aqueous solution to flow in said caustic chamber at a linear velocity of at least 1 cm/sec.

2. The method according to claim 1, wherein the linear velocity of said caustic alkali aqueous solution is from 1 cm/sec to 10 cm/sec.

* * * * *